United States Patent [19]

Trelease

[11] 4,054,035

[45] Oct. 18, 1977

[54] VENTILATION AIR TEMPERING DEVICE

[75] Inventor: Stephen W. Trelease, Louisville, Ky.

[73] Assignee: American Air Filter Company, Inc., Louisville, Ky.

[21] Appl. No.: 714,479

[22] Filed: Aug. 16, 1976

[51] Int. Cl.[2] ..... F25B 43/00

[52] U.S. Cl. ..... 62/83; 165/16; 165/29

[58] Field of Search ..... 165/16, 22, 29; 62/324, 62/160, 83

[56] References Cited

U.S. PATENT DOCUMENTS

| | | | |
|---|---|---|---|
| 3,823,572 | 7/1974 | Cochran | 165/22 |
| 3,848,664 | 11/1974 | Perry et al. | 165/22 |
| 3,853,172 | 12/1974 | McFarlan | 165/22 |

*Primary Examiner*—William E. Wayner
*Assistant Examiner*—Robert Charvat
*Attorney, Agent, or Firm*—Jon C. Winger

[57] ABSTRACT

A multi-zone heating-cooling system having a plurality of reversible cycle air heating and cooling units connected to a closed loop water circulation circuit, and at least one ventilating air tempering coil in liquid flow communication with the water flowing in the closed loop water circulation circuit and in heat exchange relationship with a stream of outdoor air such as might be used for ventilation.

3 Claims, 1 Drawing Figure

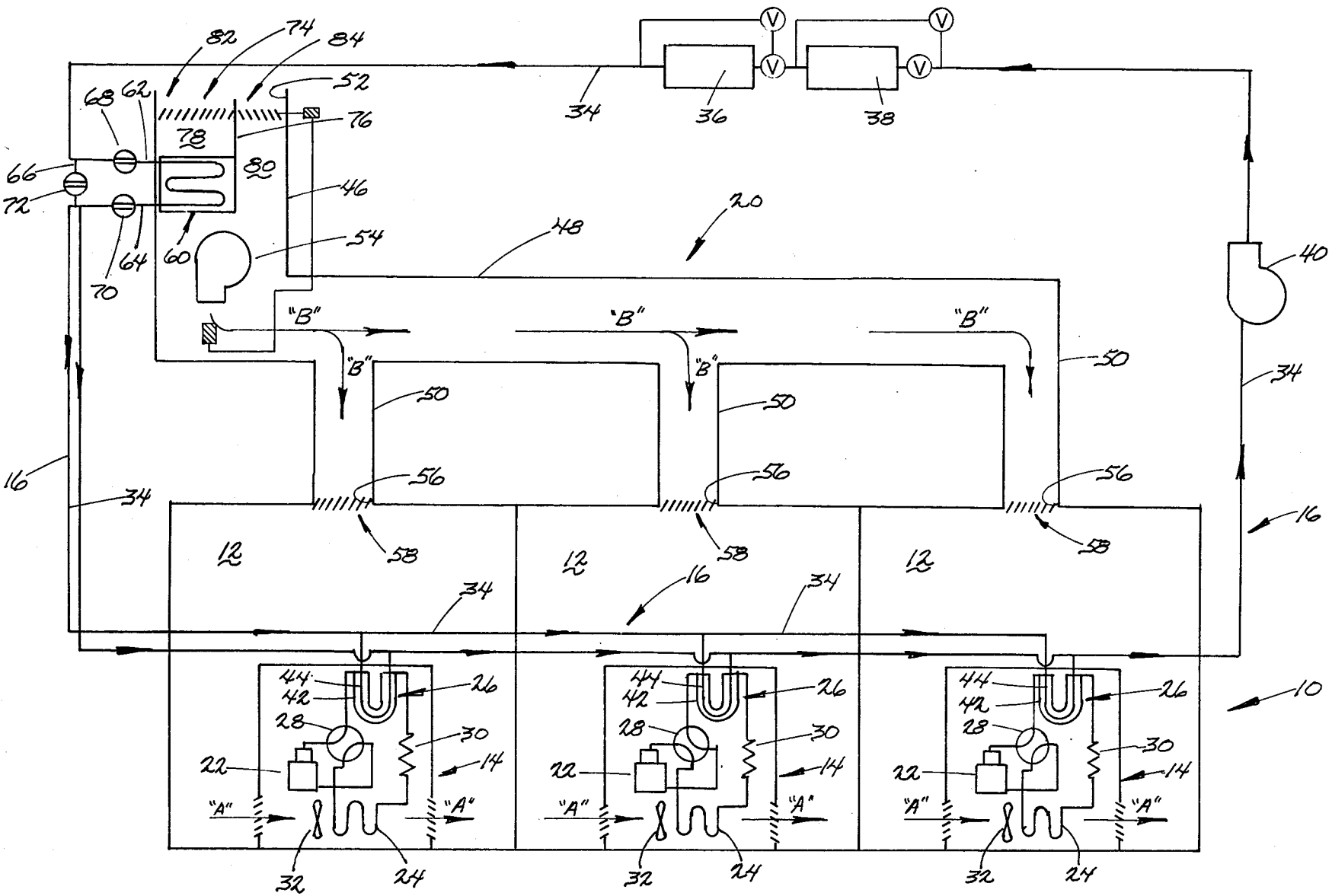
10
12
14
16
18
20
22
24
26
28
30
32
34
36
38
40
42
44
46
48
50
52
54
56
58
60
62
64
66
68
70
72
74
76
78
80
82
84
"A"
"B"

VENTILATION AIR TEMPERING DEVICE

BACKGROUND OF THE INVENTION

The present invention relates to heat exchange devices and more particularly to reversible cycle heating-cooling devices employing a closed loop water circuit with means for tempering incoming outdoor ventilating air.

Reversible cycle heating-cooling systems having a closed loop water circulation circuit are known. The closed loop water circulation circuits are used to circulate water within a predetermined temperature range through the water-refrigerant contact coils in the reversible cycle heat-cooling units of the heating-cooling system in order to exchange heat with the refrigerant, thus, increasing the efficiency of the reversible cycle units and conserving energy. Prior art devices of this type are disclosed in U.S. Pat. No. 2,715,514 issued on Aug. 16, 1955 to W. S. Stair; U.S. Pat. No. 3,523,575 issued on Aug. 11, 1970 to J. B. Olivieri; and U.S. Pat. No. 3,630,271 issued on Dec. 28, 1971 to Herbert M. Brody.

Most buildings require a certain amount of make-up air or ventilation air to replace the air lost from the building due to the operation of equipment which functionally utilizes air, and to keep the air within the building fresh and suitable for humans. This make-up air or ventilation air is usually supplied from the outdoors through a ventilation system which ducts the ventilation air to various zones, such as rooms, into which the building is divided. In installations utilizing a reversible cycle heating and cooling system to temper the building air, the ventilation system is frequently completely separate and divorced from the heating-cooling system. The reversible cycle heating-cooling system is used to selectively heat or cool the air already in the building. In cold weather, the heating system must constantly heat the cold incoming ventilation air. This places an extra heating burden on the heating system over and above what it would be if no ventilation air were introduced into the building.

A solution to this problem is to pre-heat the incoming ventilation air before the ventilation system introduces it into the zones served by the reversible cycle heating system. The prior art method known to me is to use heating means such as an electric heater, hot water supplied heater, steam supplied heater and the like, disposed in the ventilation system. These prior art solutions all have two things in common. They all require the input of energy and they are separate and independent entities from the reversible cycle heating-cooling system.

Thus, a need exists for a device which is capable of pre-heating ventilation air without placing an extra burden on many or all of the reversible cycle heating-cooling units and which further, does not require as much additional energy.

SUMMARY OF THE INVENTION

The present invention recognizes the problem and provides a solution which obviates the drawbacks of the prior art. Additionally, the present invention is straightforward, and simple in construction, and therefore relatively inexpensive to manufacture, install and maintain in use.

More particularly, the present invention provides a multi-zone heating-cooling system of the type comprising: a plurality of reversible cycle air heating-cooling units of the type which individually comprises at least one water-contacted refrigerant coil operable to selectively function as a refrigerant condenser or refrigerant evaporator; and, a closed loop water circulation circuit connected with said water-contacted refrigerant coil in each reversible cycle air heating-cooling unit to exchange heat with the refrigerant flowing through said water-contacted refrigerant coil so that heat extracted from the refrigerant in the water-contacted refrigerant coils accumulates in the water flowing through the closed loop water circulation circuit; the improvement which comprises:

means for heating ventilation air, said means being disposed in water flow communication with the closed loop water circulating circuit and in heat exchange relationship with the ventilation air.

BRIEF DESCRIPTION OF THE DRAWINGS

The preferred embodiment of the present invention will be described with reference to the accompanying schematic view of a multi-zone reversible cycle heating-cooling unit serving a plurality of zones within an enclosure or building.

DESCRIPTION OF THE PREFERRED EMBODIMENT

The drawing shows an enclosure of a building, generally denoted as the numeral 10, divided into a plurality of zones or rooms 12 (only three being illustrated for the sake of clarity).

A multi-zone reversible cycle air heating-cooling system is illustrated as comprising a reversible cycle air heating-cooling unit 14 for each of the several zones 12, and a closed loop water circulation circuit 16 for conveying water to and from the heating-cooling units 14.

The building 10 comprises a fresh air ventilation or make-up system, denoted as the numeral 20, for supplying make-up or ventilation air from the outdoors to the various zones 12. Usually, buildings also include an air re-circulation system which re-circulates air through the various zones, and an exhaust system for removing stale air from the building. However, because neither the re-circulation system nor the exhaust system functions with or has any relationship to the present invention, are well known in the art, and would only confuse this disclosure, they are not shown nor discussed further.

The individual reversible cycle air heating-cooling units 14 each comprise a refrigerant compressor 22, a refrigerant-air contacted coil 24, a refrigerant-water contacted coil such as a tube-in-tube 26, a refrigerant flow reversing valve 28, refrigerant expansion means, such as capillary 30, and a zone air moving fan 32 for moving zone air to be treated over or past the refrigerant-air contacted coil 24 as indicated by the flow arrows A.

The closed loop water circulation circuit 16 comprises a water circulation conduit 34; a heat rejector 36, such as a closed circuit evaporative water cooler, in fluid communication with the water flowing in the conduit 34; a heater 38, such as an electric heater, in fluid flow communication with the water flowing in the conduit; and a water pump 40 connected in the conduit 34 to pump the water through the circuit 16 in a direction indicated by the arrow heads.

Referring again to the individual heating-cooling units 14, each refrigerant-water contacted coil 26 comprises an outer conduit 42 for refrigerant flow and an inner conduit 44 for water flow. The outer conduit 42 is in refrigerant flow communication with the refrigerant compressor 22, the refrigerant-air contacted coil 24, the refrigerant flow reversing valve 28 and the refrigerant expansion capillary 30. The inner conduit 44 is connected in fluid flow communication to the water circulation conduit 34.

The fresh air ventilation system 20 comprises an outside air inlet duct 46 which is connected to a ventilation air distribution duct 48, and a number of ventilation air discharge ducts 50 corresponding to the number of zones 12 to be served by the ventilation system. Outdoor ventilating air is drawn into the ventilating system 20 through an inlet opening 52 in the inlet duct 46 by means of a fan 54 located in the inlet duct 46. The ventilating air passes from the inlet duct 46 into and along the distribution duct 48 and hence into and through the discharge ducts 50 wherefrom it is discharged into the zones 12 through an outlet opening 56 in each discharge duct 50 as indicated by the arrows "B". Either a movable or fixed distribution damper 58 can be placed over the outlet opening 56 to evenly distribute and disperse the ventilating air across the zone.

Typically, each zone 12 has a thermostat (not shown) operatively connected to the reversible cycle heating-cooling unit 14 disposed in the zone. The thermostat controls the hearing and cooling function of the unit 14 in response to varying zone temperature requirements and conditions.

With reference to the left-most zone 14 in the drawing, in operation, upon a demand signal from the thermostat for cooling, the reversing valve 28 is moved to a position to guide a flow of hot high pressure refrigerant gas from the compressor 22 through the outer conduit 42 of the tube-in-tube coil 26 which serves in this instance as a condensor. In the coil 26, heat is removed from the hot refrigerant gas by the cool water flowing through the inner conduit 44, thus, cooling the refrigerant which condenses it into a liquid, and, at the same time heating the water flowing through the inner conduit 44. The liquid refrigerant then flows from the coil 26 through the expansion device 20 wherein the liquid refrigerant is expanded to a lower pressure. From the expansion device 30, the low pressure liquid refrigerant flows to the refrigerant-air contacted coil 24. The air moving fan 32 moves zone air across the coil 24 and becomes a vapor. The now refrigerant vapor then flows through the reversing valve 28 and back to the compressor 22, thus, completing the cooling cycle. The compressor re-compresses the refrigerant gas to a high pressure hot gaseous state and the cycle is repeated. The cool zone air is discharged into the zone.

As mentioned during the cooling cycle, the water flowing in the closed loop water circulation circuit 16 is heated in the tube-in-tube coil 26 by extracting heat from the hot high pressure refrigerant. This heated water continuously circulates and serves as a heat sink. The cooling of the zone is done by the refrigerant, not the water flowing in the closed water circuit 16.

With reference to the middle zone 14 in the drawing, upon a demand signal from the thermostat for heating, the reversing valve is caused to move to reverse the flow of refrigerant in all parts of the heating-cooling unit 14 except the compressor 22. In this heating mode, hot high pressure refrigerant gas passes from the compressor 22 through the reversing valve 28 to the refrigerant-air contacted coil 24. The hot refrigerant gas in the coil 24 condenses to a liquid and in so doing gives off heat which is absorbed by the zone air passing over the coil 24. The hot zone air is discharged to the zone. The liquid refrigerant flows from the coil 24 through the expansion device 30 wherein the pressure of the liquid refrigerant is reduced. From the expansion device 30, the liquid refrigerant then flows to the outer conduit 42 of the tube-in-tube coil 26 which serves in this instance as an evaporator. In the coil 26, the refrigerant absorbs heat from the water flowing through the inner conduit 44, thus heating the liquid refrigerant and causing it to vaporize, and, at the same time cooling the water. The refrigerant vapor then flows through the reversing valve 28 and back to the compressor 22, thus, completing the heating cycle. The compressor recompresses the low pressure refrigerant vapor and the cycle is repeated.

As mentioned, during the heating cycle the water flowing in the closed water loop circulation circuit 16 is cooled in the tube-in-tube coil 26 by giving off its stored heat to the liquid refrigerant. This water continuously circulates and serves as a source of heat for vaporizing the liquid refrigerant. The heating of the zone is done by the refrigerant, not the water flowing in the closed water circuit 16.

During hot weather with most, or all of the reversible cycle units 14 in a multi-zoned building 10 cooling the zone air; eventually the heat continuously absorbed by the water flowing in the closed loop circuit will increase the water temperature above a value sufficient for continued efficient heat transfer from the hot refrigerant to the water. In practice, this water temperature has been determined to be approximately 90° F. Likewise, during cold weather with most, or all of the reversible cycle units 14 heating the zone air; eventually the heat continuously absorbed by the refrigerant from the water will decrease the water temperature below a value sufficient for continued efficient heat transfer to the refrigerant. In practice, this water temperature has been determined to be approximately 60° F. The function of the heat rejector 36 and heater 38 is to maintain the temperature of the water in the closed loop water circuit 16 between the temperature limits of 60° F and 90° F. The heat rejector 36 and heater 38 are activated by means of water temperature sensors (not shown) disposed in the water circulation conduit 34 in a manner as known in the art. When the water temperature drops below 60° F the heater 38 is activated to heat the water, and when the water temperature rises above 90° F the heat rejector is activated to cool the water. Neither the heat rejector 36 nor heater 38 are activated when the water temperature is between 60° F and 90° F.

Even in cold weather, when some of the reversible cycle heater-cooler units 14 of a multi-unit system are in a heating mode, others, particularly those serving core zones interior to the building 10, may be either in a cooling mode or idle because the zone requirements are satisfied. It should be noted that in well insulated buildings the heat loss from core zones is minimal and, therefore, a unit 14 serving the core zone will almost always remain in a cooling mode even during cold weather. Of course, any units 14 in a cooling mode are rejecting heat to the water, and any idle units are neither adding heat to nor removing heat from the water.

During mild weather, such as in the spring and fall of the year, some of the reversible cycle units 14 will be in a heating mode, other units 14 will be in a cooling mode and yet others will be idle. Each reversible cycle heating-cooling unit 14 will also cycle between the cooling mode and heating mode as the temperature of the air in its zone fluctuates. Thus, it is typical that at any given time some reversible cycle units 14 will be in a cooling mode rejecting heat into the closed loop water circulating system 16. Further, it should be noted that even during mild weather the outdoor air is chilly or tepid. The outdoor air is frequently cooler than the zone air.

Any outdoor ventilation air added to the zones through the ventilation system 20 will be at the outside air temperature. Thus, in cold or mild weather the air temperature in the zone will be lowered by the ingress of ventilation air. When the zone air temperature drops below the temperature set point of the thermostat, the reversible cycle unit 14 will be activated to a heating mode. This places an extra heating load on the reversible cycle heater-cooler units 14 causing them to operate more often and for longer periods of time than would be required if no cold ventilation air were added to the zone.

The object of the present invention is to take advantage of the residual heat in the water of the closed loop water circulation system 16 to alleviate the extra heating load on the reversible cycle heating cooling units due to the effect of cold ventilation air entering the zones.

A ventilating air temperature coil, such as a heat rejecting water-air contacted coil 60 is disposed in the inlet duct 46 of the fresh air ventilating system 20 downstream of the inlet opening 52. Preferably, the water-air contacted coil 60 is not placed all the way across the inlet duct 46, but is spaced from one wall of the duct as illustrated. The water-air contacted coil 60 is placed in fluid communication with the water flowing in the water circulation conduit 34 by means of a water supply conduit 62 which conducts water to the water-air contacted coil 60 and a water return conduit 64 which conducts water from the water-air contacted coil back to the water circulation conduit 34. A water by-pass conduit 66 is connected between the water supply conduit 62 and water return conduit 64. A normally open manually actuated valve 68 is placed in the water supply conduit 62, a normally open manually actuated valve 70 is placed in the water return conduit 64, and a normally closed manual valve 72 is placed in the water by-pass conduit 66. Thus, if for some reason, such as repair, it is required to remove the water-air contacted coil 60 it can be done without shutting the closed loop water circulation system 16 by the simple expedient of closing valves 68 and 70 and opening valve 72 thereby allowing water to flow from the water circulation conduit 34 into the water supply conduit 62, through the by-pass conduit 66 into the return conduit 64 and back into the circulation conduit 34 by-passing the water-air contacted coil 60.

Preferably, a "face and by-pass" air damper 74 is disposed in the inlet duct 46 upstream of the water-air contacted coil 60. The "face and by-pass" damper assembly 74 comprises a partition 76 generally extending in an upstream direction from the edge of the coil 60 which is spaced from the wall of the duct 46. Thus, the partition 76 divides the duct 46 into two air flow channels. One flow channel 78 is in alignment with the coil 60 to direct ventilating air through the coil 60. The other flow channel 80 is aligned with the space between the edge of the coil 60 and wall of the duct 46 to direct ventilating air into the space thereby by-passing the coil 60. The "face and by-pass" damper assembly 74 further comprises a set of movable "face" damper blades 82 disposed across the flow channel 78 upstream of the coil 60 and a set of movable "by-pass" damper blades 84 disposed across the by-pass flow channel 80 also upstream of the coil 60. The damper blades 82 and damper blades 84 are functionally connected together by means known in the art (not shown) so that as one set of damper blades move between the open position allowing air flow therethrough and the closed position preventing air flow therethrough, the other set of dampers move a like amount, but in the opposite direction. As is also known in the art, the movement of the sets of damper blades 82 and 84 is controlled by means of, for example, a reversible electric motor (not shown) which is actuated by means of a temperature sensor (not shown) disposed in the ventilating air stream flowing through the inlet duct 46 downstream of the water-air contacted coil 60.

During cold or mild weather outdoor ventilating air flowing in the flow channel 78 and across the water-air contacted coil 60 will extract heat from the water flowing through the coil 60 from the water circulation conduit 34 and will, thus, be heated.

The ventilating air temperature sensor can be set at a predetermined temperature set point, say 70° F so that it will actuate the damper motor to move the face damper blades between the open and closed positions and move the by-pass damper blades in an opposite direction an amount sufficient to maintain a ventilation air temperature downstream of the coil 60 at, or as near as possible to, the desired predetermined set point. This heated ventilation air is then conducted to the various served zones 12 through the distribution duct 48 and various discharge ducts 50. The now warmer ventilating air being distributed to the zones 12 does not lower the zone air temperature as would cold ventilation air and, therefore, does not place as great an additional heating load on the reversible cycle units 14. Furthermore, because the residual heat of the water in the closed loop water circulation conduit is used to heat the ventilation air, a net savings in energy is realized.

Of course, under those conditions when the water temperature drops below 60° F, thus, causing the supplementary heater 38 to be actuated, there will be no energy saving realized by the use of the water to heat the ventilating air. But, by the same token there will not be any increase in energy consumption by continuing to heat the ventilating in this manner over what the energy consumption is in a prior art system not so heating the ventilating air. Thus, a net energy savings is realized over a heating season as opposed to a day-to-day accounting period.

The foregoing detailed description is given primarily for clarity of understanding and no unnecessary limitations should be understood therefrom, for modifications will become obvious to those skilled in the art upon reading the disclosure and may be made without departing from the spirit of the invention and scope of the appended claims.

What is claimed is:

1. In a heating and cooling system of the type comprising at least one reversible cycle air cooling and heating unit of the type comprising at least one refrigerant-water contacted coil; and, refrigerant control means operable to selectively cause the refrigerant-water contacted coil to operate as a refrigerant condensor or to act as a refrigerant evaporator;

a closed loop water circulation circuit connected with the refrigerant-water contacted coil to achieve heat with the refrigerant flowing therethrough so that heat extracted from the refrigerant flowing through the refrigerant-water contacted coil accumulates in the water flowing through the closed loop water circulation circuit; and, an outdoor ventilation system for supplying outdoor air to the zones served by the cooling and heating unit;

the improvement which comprises:

at least one water-air contacted coil disposed in liquid flow communication in the closed loop water circulation circuit and selectively in heat exchange relationship with only a ventilation air stream flowing in the outdoor ventilation system for selectively heating only outdoor ventilation air before the outdoor ventilation air is discharged to the served zone continuously; and, means for allowing a selected amount of outdoor ventilation air to pass through the water-air contacted coil and allowing a selected amount of outdoor ventilation air to bypass the water-air contacted coil.

2. The heating and cooling system of claim 1, wherein the means for allowing a selected amount of outdoor ventilation air to pass through the water-air contacted coil and allowing a selected amount of outdoor ventilation air to bypass the water-air contacted coil comprises:

means defining an outdoor air flow channel communicating with the water-air contacted coil to direct outdoor ventilation air through the water-air contacted coil;

first damper means for selectively allowing and preventing outdoor ventilation air to pass through the channel communicating with the water-air contacted coil;

means defining another outdoor air ventilation channel to allow outdoor ventilation air to bypass the water-air contacted coil; and, second damper means for selectively preventing and allowing outdoor ventilation air from passing through the channel bypassing the water-air contacted coil.

3. The heating and cooling system of claim 2, further comprising temperature responsive damper actuating means response to the temperature of the outdoor ventilation air downstream of the air flow channels for activating the damper means controlling air flow through the air flow channels to control the amount of outdoor air flowing through the water-air contacted coil and the amount of air bypassing the water-air contacted coil.

* * * * *